US006601686B1

(12) United States Patent
Ishida et al.

(10) Patent No.: US 6,601,686 B1
(45) Date of Patent: Aug. 5, 2003

(54) VENDING MACHINE

(75) Inventors: Takeshi Ishida, Sakado (JP); Tsunehiro Aso, Kawagoe (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 132 days.

(21) Appl. No.: 09/786,800

(22) PCT Filed: Jul. 12, 2000

(86) PCT No.: PCT/JP00/04650

§ 371 (c)(1),
(2), (4) Date: Mar. 7, 2001

(87) PCT Pub. No.: WO01/04845

PCT Pub. Date: Jan. 18, 2001

(30) Foreign Application Priority Data

Jul. 12, 1999 (JP) ..... 11-198088

(51) Int. Cl.[7] ..... G07D 5/00

(52) U.S. Cl. ..... 194/202; 194/217; 453/2; 453/58

(58) Field of Search ..... 194/202, 215, 194/217, 302, 317; 453/58, 2

(56) References Cited

U.S. PATENT DOCUMENTS 4,109,774 A * 8/1978 Hayashi ..... 194/215
5,184,708 A * 2/1993 Levasseur ..... 194/217
5,366,058 A * 11/1994 Kurosu ..... 194/202
6,053,299 A * 4/2000 Rollins ..... 194/200
6,082,518 A * 7/2000 Itako et al. ..... 194/317
6,247,573 B1 * 6/2001 Itako et al. ..... 194/202

FOREIGN PATENT DOCUMENTS

| | | |
|---|---|---|
| JP | 57-17091 | 1/1982 |
| JP | 58-54772 | 4/1983 |
| JP | 02-14177 | 1/1990 |
| JP | 08-44912 | 2/1996 |
| JP | 08-153251 | 6/1996 |

* cited by examiner

*Primary Examiner*—Dean J. Kramer
(74) *Attorney, Agent, or Firm*—Welsh & Katz, Ltd.

(57) ABSTRACT

A vending machine capable of preventing fraudulent use of false coins of a plurality of kinds. The number of slotted coins acceptable in one vending operation is preset in setting unit (112). The coins slotted into a coin slotting unit (101) are counted based on the sensing output from a counting sensor (104). When a refund operation is carried out while the number of coins slotted into the coin slotting unit(101) is equal to or larger than the preset acceptable number of coins set in the setting unit (112), the coin return in response to the refund instruction is inhibited as a fraudulent use.

10 Claims, 10 Drawing Sheets

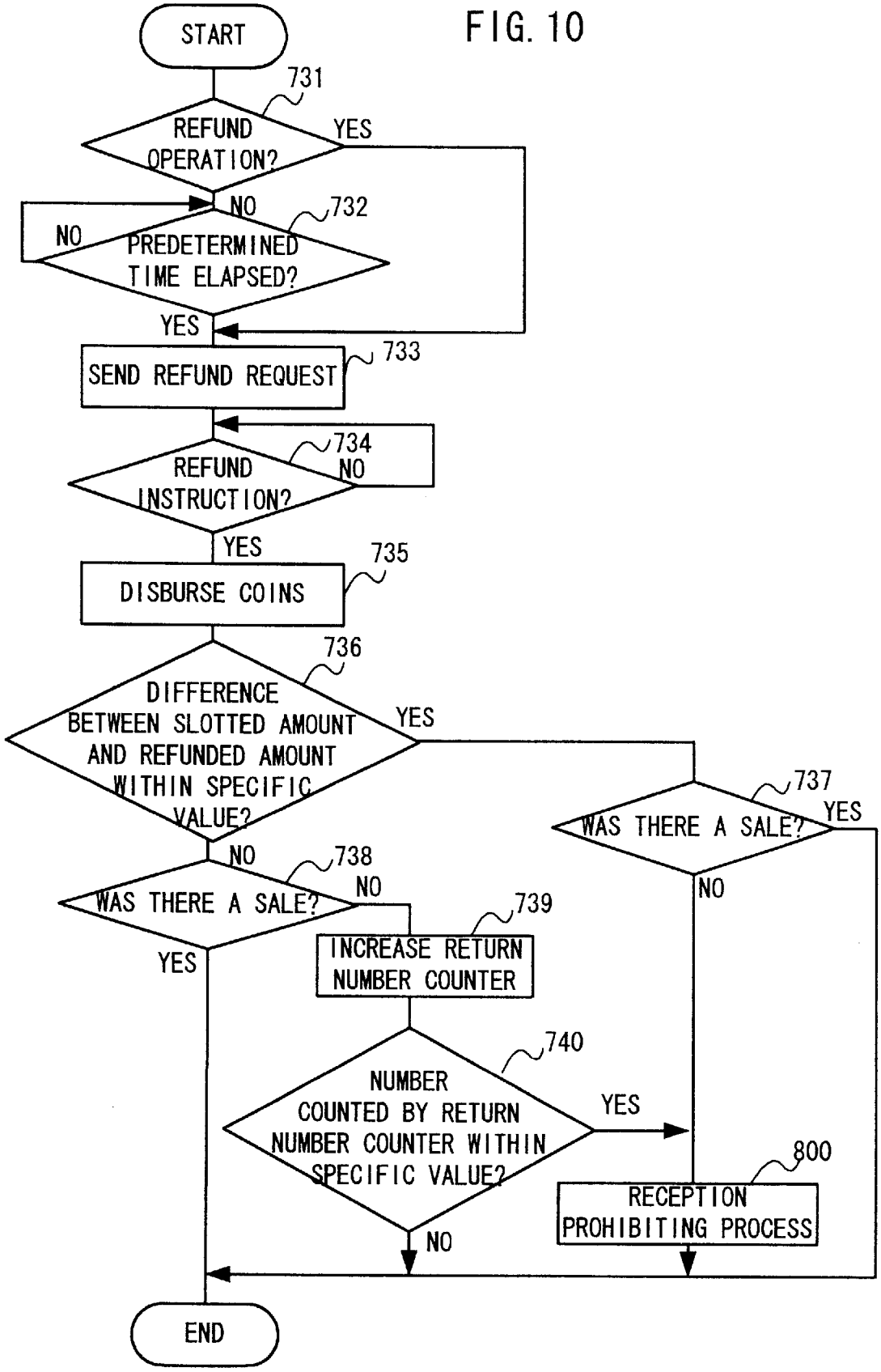
FIG. 10
START
731
REFUND OPERATION?
YES
NO
732
NO
PREDETERMINED TIME ELAPSED?
YES
SEND REFUND REQUEST
733
734
REFUND INSTRUCTION?
NO
YES
735
DISBURSE COINS
736
DIFFERENCE BETWEEN SLOTTED AMOUNT AND REFUNDED AMOUNT WITHIN SPECIFIC VALUE?
YES
737
WAS THERE A SALE?
YES
NO
NO
738
WAS THERE A SALE?
NO
YES
739
INCREASE RETURN NUMBER COUNTER
740
NUMBER COUNTED BY RETURN NUMBER COUNTER WITHIN SPECIFIC VALUE?
YES
NO
800
RECEPTION PROHIBITING PROCESS
END

VENDING MACHINE

TECHNICAL FIELD

The present invention relates to a vending machine accepting coins, and more particularly, to a vending machine in which fraudulent use with false coins can be largely prevented.

BACKGROUND ART

Generally, vending machines can sell various kinds of merchandise without necessitating human help, so that due to this convenience they are used in a wide variety of usage forms and they are installed in numerous places.

Such vending machines accept either coins only or bills and coins, and in particular coins are sorted into true or false by electrically or mechanically discriminating their material, diameter, surface pattern, etc.

However, among the coins of the world, there are coins that are very similar with regard to material, diameter, and surface pattern, and there are numerous incidents, in which such coins are treated and applied to fraudulent use with vending machines of another country. This is done by slotting into a vending machine a large amount of false coins corresponding to a certain denomination, and then either pressing the return button or pressing the return button after purchasing the merchandise of the lowest price.

That is to say, in vending machines that accept coins, the coins are reused as change, so that the coins that can be used as change are temporarily accumulated in an accumulation device also known as the coin tube, and for a sale of merchandise that requires change, the change is disbursed using the coins that have accumulated in the coin tube.

Therefore, when a large amount of false coins corresponding to a certain denomination is slotted into a vending machine, and then either the return button is pressed or the return button is pressed after purchasing the merchandise of the lowest price, then true coins accumulated in the coin tube are returned for the slotted false coins or as change, so that it is possible to get hold of the true coins in the vending machine, in exchange for the false coins.

In particular in recent vending machines, there is the tendency to enlarge the number of coins that can be accumulated in the coin tubes, in order to eliminate shortages of coins for change, which leads to a situation in which a large amount of true coins can be lifted from a vending machine with a fraudulent operation using these false coins.

Conventional methods for preventing fraudulent operation of vending machines using false coins include:

1) Increasing the precision with which coins are sorted into true and fraudulent; and 2) Prohibiting the use of coins that can be used fraudulently.

However, increasing the precision with which coins are sorted into true and fraudulent as in method 1) may lead to a situation in which, due to the increase of the precision with which coins are sorted into true and false coins that were previously accepted as true are now sorted as fraudulent.

That is to say, due to circulation, a certain degree of deformation, damage, etc. to the coins used in vending machines cannot be avoided, so that when the precision with which coins slotted into a vending machine are sorted into true and fraudulent is increased, then true coins with a certain degree of deformation, damage, etc. will be regarded as false coins and returned as well, so that the person servicing the vending machine will loose a valuable sales opportunity, and when slotted coins are not accepted and returned even though they are true, then the user of the vending machine will be hampered in his regular use of the vending machine and his mistrust in vending machines may increase.

Furthermore, if the use of coins that can be used fraudulently is prohibited as in method 2), then this causes some inconvenience if the coins that can be used fraudulently are, for example, the coins with the largest denomination accepted by this vending machine, but the function of the vending machine as such can be maintained.

However, if the coins that can be used fraudulently are coins with the denomination used most with this vending machine, then a regular functioning of the vending machine cannot be maintained.

That is to say, in method 1) of increasing the precision with which coins are sorted into true and fraudulent, there are intrinsic limits with regard to the increase of the precision, and method 2) of prohibiting the use of coins that can be used fraudulently, cannot be applied to cases where the coins that can be used fraudulently are coins with the denomination used most with this vending machine.

DISCLOSURE OF THE INVENTION

It is an object of the present invention to provide a vending machine, with which the fraudulent use with false coins of various denominations can be prevented effectively.

In order to achieve this object, the present invention is characterized in that a vending machine counting amount of slotted money, vending merchandise within a range of the counted amount of slotted money, and returning money corresponding to a return amount based on a refund instruction, comprises counting means for counting, by denomination, the number of slotted coins of the slotted money, setting means for setting, by denomination, an administrative value indicating number of slotted coins that is acceptable in one vending operation, and refund prohibiting means for prohibiting a coin refund operation based on the refund instruction, when the number of slotted coins counted by the counting means is equal to or larger than the administrative value set with the setting means.

Alternatively, the present invention is characterized in that a vending machine having a main control unit and a coin processing unit, wherein the main control unit counts amount of slotted money based on communication with the coin processing unit, calculates amount of money to be returned based on a refund request from the coin processing unit and gives the coin processing unit a refund instruction to refund coins corresponding to this amount of money to be returned, and wherein the coin processing unit returns coins based on this refund instruction, comprises counting means for counting, by denomination, the number of slotted coins, setting means for setting, by denomination, an administrative value indicating number of slotted coins that is acceptable in one vending operation, and prohibiting means for prohibiting sending of the refund request to the main control unit, if the number of slotted coins counted by the counting means is equal to or larger than the administrative value set with the setting means.

Alternatively, the present invention is characterized in that a vending machine counting amount of slotted money, vending merchandise within a range of the counted amount of slotted money, and returning money corresponding to a return amount based on a refund instruction, comprises a calculation means for calculating difference between the slotted coins in the amount of slotted money and the amount of money to be returned, and reception prohibiting means for prohibiting the reception of coins for a predetermined period of time after money corresponding to the amount to be returned is returned based on the refund instruction, if, the difference between the slotted coins in the amount of slotted money and the amount of money to be returned calculated by the calculation means is within a predetermined value.

Alternatively, the present invention is characterized in that a vending machine counting amount of slotted money, vending merchandise within a range of the counted amount of slotted money, and returning money corresponding to a return amount based on a refund instruction, comprises an slotted coin counting means for counting, by denomination, the number of slotted coins of the slotted money, setting means for setting, by denomination, an administrative value indicating number of slotted coins that is acceptable in one vending operation, a return operation counting means for counting number of coin return operations, based on the refund instruction given when the number of slotted coins counted by the slotted coin counting means is equal to or higher than the administrative value set with by setting means, and reception prohibiting means for prohibiting reception of coins when the number of coin return operations counted by the return operation counting means has reached a predetermined value.

Alternatively, the present invention is characterized in that a vending machine counting amount of slotted money, vending merchandise within a range of the counted amount of slotted money, and returning money corresponding to a return amount based on a refund instruction, comprises an slotted coin counting means for counting, by denomination, the number of slotted coins of the slotted money, setting means for setting, by denomination, an administrative value indicating number of slotted coins that is acceptable in one vending operation, a return operation counting means for counting number of return operations, when the refund instruction is given without sale of merchandise, and reception prohibiting means for prohibiting reception of coins if the refund instruction is given when the number of slotted coins counted by the slotted coin counting means is equal to or larger than the administrative value set with the setting means, and the refund instruction is issued without sale of merchandise, and if the number of return operations counted by the return operation counting means has reached a predetermined value.

BRIEF DESCRIPTION OF THE DRAWINGS

FIG. 10 is a flowchart showing yet another example of the refund process of Step 700 shown in FIG. 3.

BEST MODE FOR CARRYING OUT THE INVENTION

The following is a detailed description of embodiment of a vending machine in accordance with the present invention with reference to the accompanying drawings.

Figure 1:
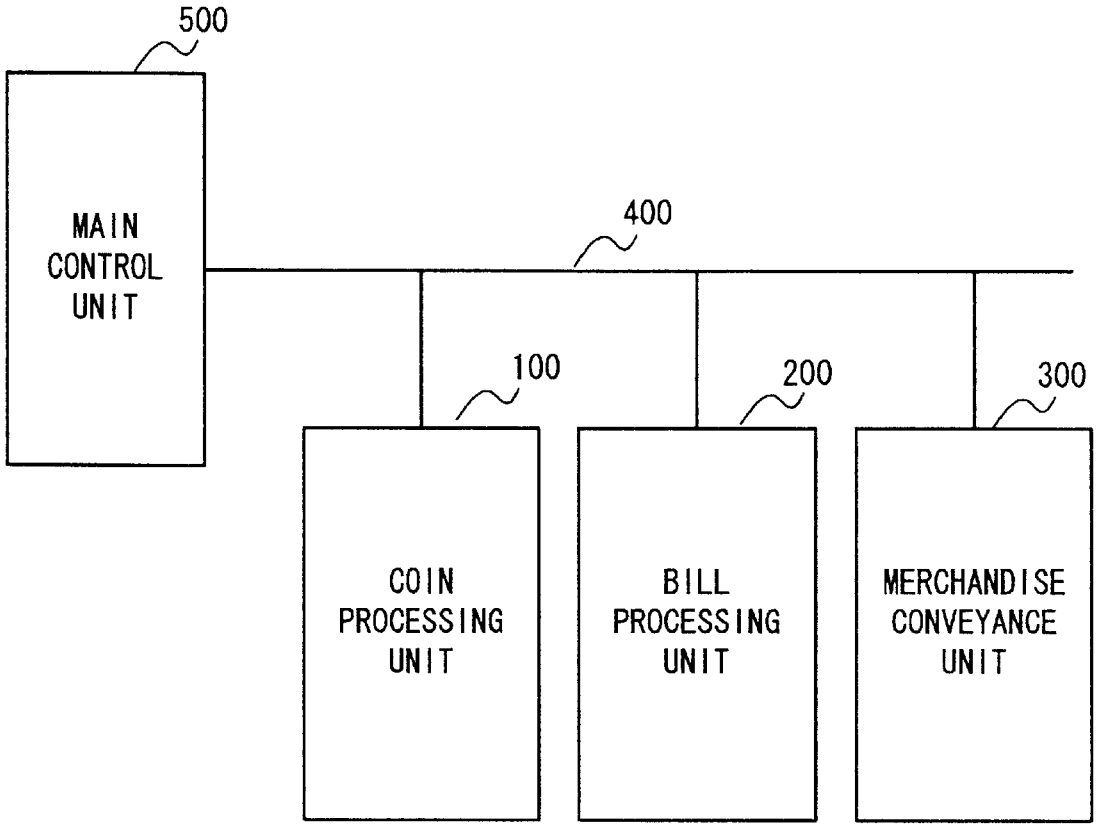
FIG. 1 is a schematic block diagram showing the overall configuration of a vending machine in accordance with the present invention.

FIG. 1 is a schematic block diagram showing the overall configuration of a vending machine in accordance with the present invention.

In FIG. 1, this vending machine is configured by connecting a coin processing unit 100, a bill processing unit, and a merchandise conveyance unit 300 over a serial communication cable 400 to a main control unit 500.

The coin processing unit 100 is a so-called "coin mechanism" mainly performing processes relating to receiving, discriminating, sorting and returning coins, based on the communication with the main control unit 500 over the serial communication cable 400.

The bill processing unit 200 is a so-called "bill validator" mainly performing processes relating to receiving, discriminating and returning bills, based on the communication with the main control unit 500 over the serial communication cable 400. The merchandise conveyance unit 300 performs process relating to the merchandise, such as conveyance of the merchandise.

An object of the present invention is to prevent fraudulent use with false coins, so that it relates mainly to the coin processing with the coin processing unit 100. Consequently, the operation of the vending machine of this embodiment is explained with focus on the coin processing by the coin processing unit 100.

Figure 2:
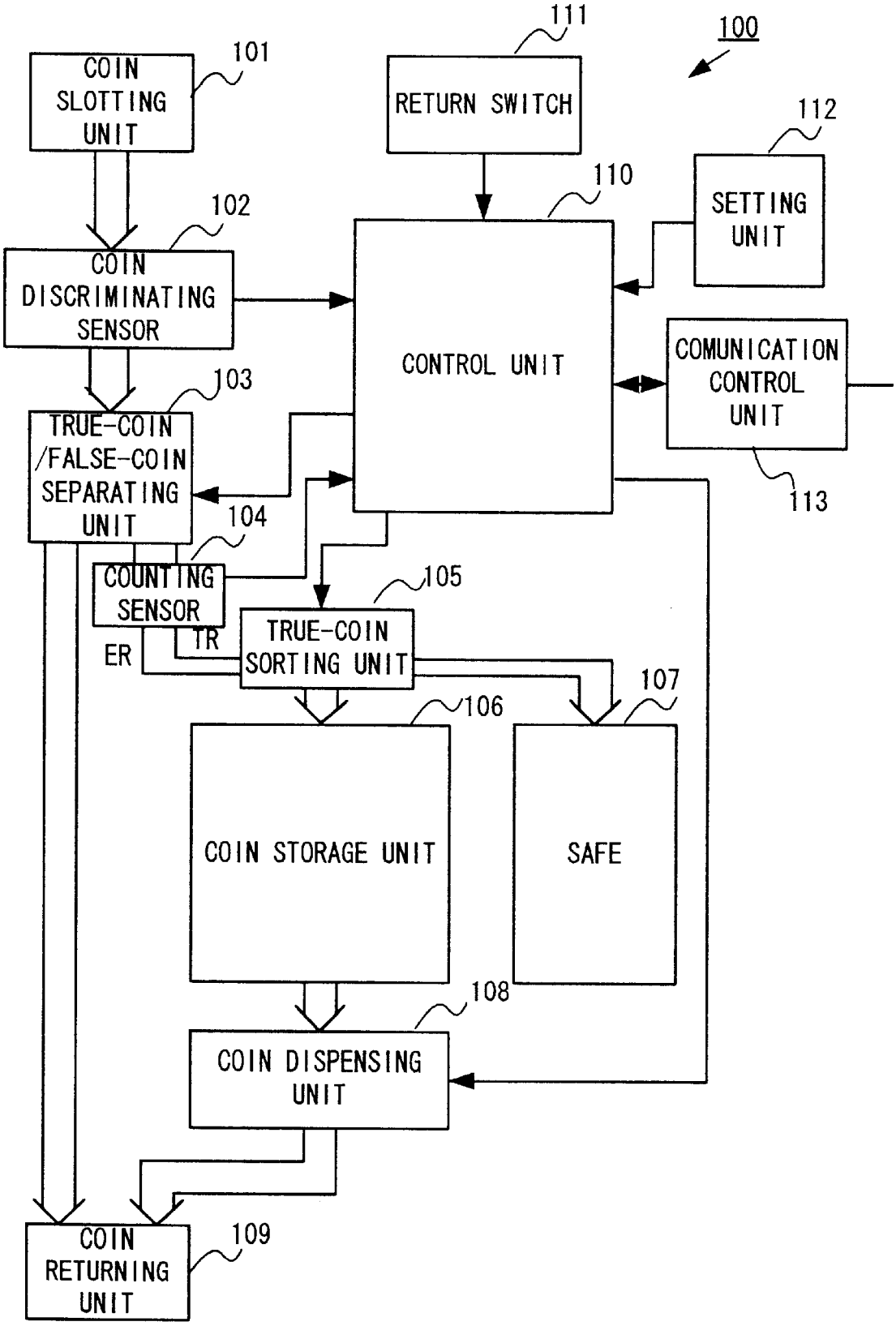
FIG. 2 is a block diagram illustrating the general structure of the coin processing unit 200 in the vending machine shown in FIG. 1.

FIG. 2 is a block diagram illustrating the general structure of the coin processing unit 200 in the vending machine shown in FIG. 1.

The coin processing unit 100 in FIG. 2 includes a coin slotting unit 101 into which coins are slotted, a coin discriminating sensor 102 for discriminating coins that are slotted into the coin slotting unit 101, a true-coin/false-coin separating unit 103 for sorting the slotted coins into true coins and false coins, based on the discrimination result from the sensing output of the coin discriminating sensor 102, a counting sensor 104 for counting the coins sorted as true by the true-coin/false-coin separating unit 103, a true-coin sorting unit 105 for sorting those coins of the true coins passing the counting sensor 104 that are used as change according to denomination and sorting them into a coin storage unit 106 and for guiding the coins that are not used as change or coins that have overflowed from the coin storage unit 106 into a safe 107, a coin accumulation unit 106 having coin tubes corresponding to denomination for accumulating by denomination the coins sorted by denomination by the true-coin sorting unit 105 and used as change, a safe 107 for storing coins sorted by the true-coin sorting unit 104 as coins not used as change or coins that have overflowed from the coin accumulation unit 106, a coin dispensing unit 108 for disbursing the necessary amount of coins from the coins accumulated in the coin accumulation unit 106, a coin returning unit 109 for returning coins sorted as false coins by the true-coin/false-coin separating unit 103 and coins disbursed by the coin dispensing unit 108, a control unit. 110 for controlling the entire operation of the coin processing unit 100, a return switch 111 for giving a return request to the control unit 110, a setting unit 112 for performing various kinds of settings to the control, unit 110, and a communication control unit 113 for controlling the communication with the main control unit 500 shown in FIG. 1.

In the vending machine of this embodiment, the number of slotted coins that is acceptable in one vending operation is set beforehand with the setting unit 112, the number of coins slotted into the coin slotting unit 101 is counted based on the sensing output of the counting sensor 104, and if a refund operation is performed while the number of coins slotted into the coin slotting unit 101 is equal to or greater than the acceptable number of slotted coins set with the setting unit 112, then this is taken as fraudulent use and a return operation of coins based on a refund instruction is not permitted.

Also if a refund operation is performed after the merchandise is sold, and the difference between the amount of slotted money and the amount of money to be returned is within a preset predetermined range of values, then this is taken as fraudulent use and subsequently the reception of slotted coins is not permitted for a predetermined period of time.

Also if the procedure of slotting a large number of coins and refunding the money without buying merchandise is carried out repeatedly, then this is taken as fraudulent use and subsequently the reception of slotted coins is not permitted for a predetermined period of time.

With this configuration, it becomes very difficult to get hold of the true coins in the vending machine by fraudulent use with false coins, and fraudulent use with false coins can be largely prevented.

Figure 3:
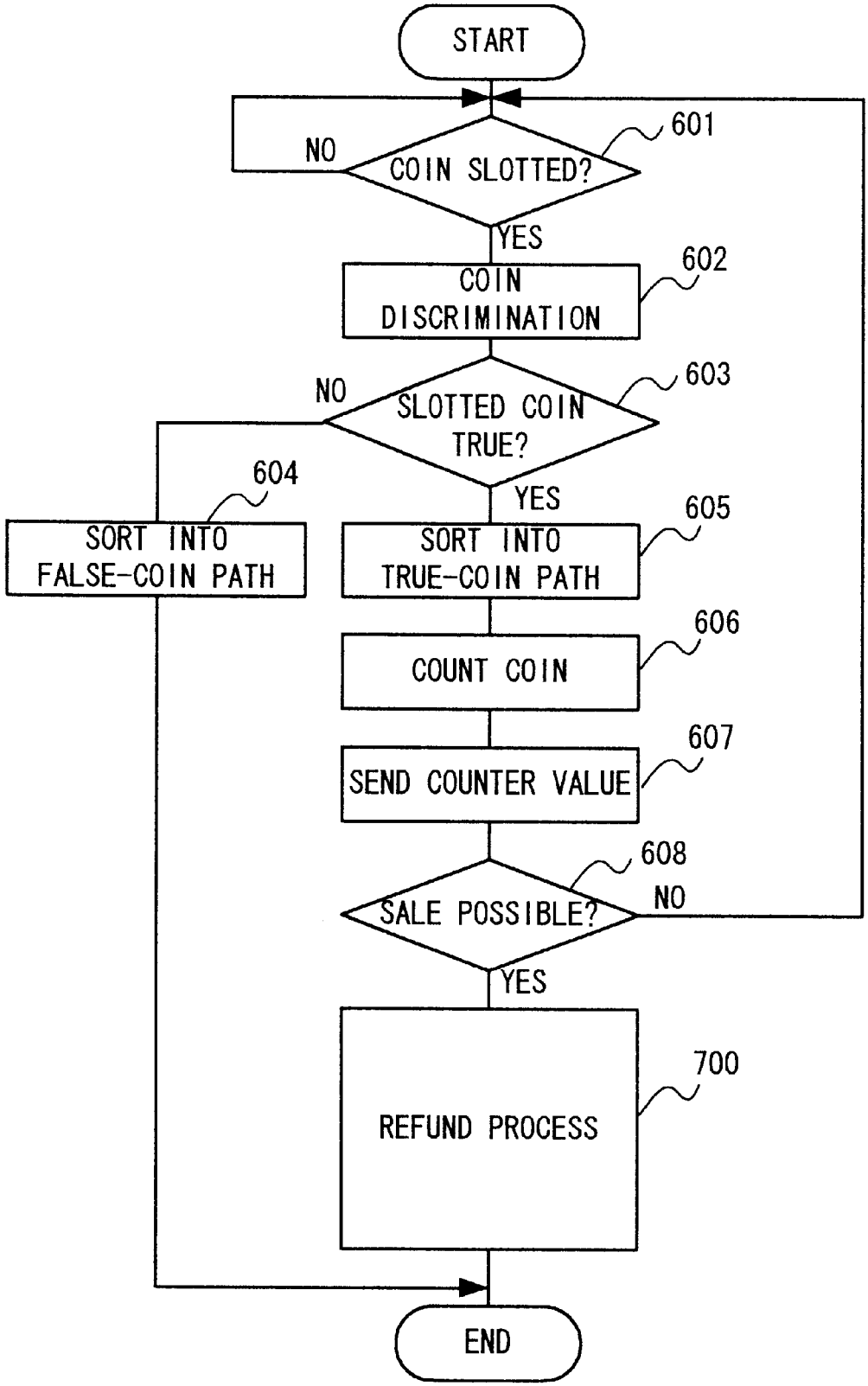
FIG. 3 is a flowchart showing the operation of the control unit 110 of the coin processing unit 100 shown in FIG. 2.

FIG. 3 is a flowchart showing the operation of the control unit 110 of the coin processing unit 100 shown in FIG. 2.

In FIG. 3, based on the sensing output of the coin discriminating sensor 102, the control unit 110 first determines whether a coin is slotted into the coin slotting unit 101, that is, whether there is a slotted coin (Step. 60).

If it is determined that there is no slotted coin (Step 601: NO), then the procedure waits until a coin is slotted into the coin slotting unit 10, and if it is determined that there is a slotted coin (Step 201: YES), then a coin discrimination process is performed, based on the sensing output of the coin discriminating sensor 102 (Step 602). If the coin discriminating sensor 102 is an electronic discrimination sensor using a detection coil, then the process of discriminating the slotted coin is performed for example by comparing the sensing output level of the coin discriminating sensor 102 with preset decision levels corresponding to predetermined denominations.

That is to say, the decision levels corresponding to the denominations are preset in the control unit 110, for example by setting with a setting unit 112, and when the sensing output level of the coin discriminating sensor 102 is within a decision level range corresponding to a certain denomination, then it is discriminated that the denomination of this coin is a true coin of this denomination, and if it does not belong to a decision level range corresponding to a certain denomination, then it is discriminated that the coin is a false coin.

Here, the coin identification sensor 102 includes a plurality of detection coils that are magnetized by signals with frequencies as suitable for the material, diameter, surface pattern, etc. of the coins, and based on the sensing output of this plurality of detection coils, the control unit 110 determines comprehensively the denomination of the slotted coins, and whether the slotted coin is a true coin or a false coin.

Then, based on the discrimination result of the coin discrimination process in Step 602, it is determined whether the slotted coin is a true coin (Step 603). If it is determined that the slotted coin is not a true coin, that is, if it is determined that it is a false coin (Step 603: NO), then the true-coin/false-coin separating unit 103 is caused to select the false-coin path ER, the slotted coin is guided over the false-coin path ER to the coin returning unit 109, and the procedure is terminated.

If, based on the discrimination result of the coin discrimination process in Step. 602, it is determined that the slotted coin is a true coin (Step 603: YES), then the true-coin/false-coin separating unit 103 is caused to select the true-coin path TR, and the slotted coin is guided to the true-coin path TR.

The true coin guided to the true-coin path TR is detected by the counting sensor 104. The control unit 110 counts the number of slotted coins based on the sensing output of this counting sensor 104 and the denomination detected in Step 602 (Step 606), and the counting result (counter value) is sent overt the communication control unit 123 to the main control unit 500 (Step 607).

Based on the counted number of slotted coins sent by the coin processing unit 100 and the number of slotted bills similarly sent by the bill processing unit 200 shown in FIG. 1, the main control unit 500 determines whether sale of merchandise is possible, and if it is determined that the amount of slotted money is equal to or higher than the price of the merchandise sold and sale is possible, then a signal "sale possible" is sent out.

The control unit 110 of the coin processing unit 100 monitors the "sale possible" signals from the main control unit 500 over the communication control unit 123, and determines whether sale has become possible (Step 608).

If it is determined that sale is not possible (Step 608: NO), then the procedure returns to Step 601, waits until the next coin is slotted, and the processing of step 601 through step 608 is repeated until Step 608 determines that sale is possible. (Step 608: YES).

When Step 608 determines that sale is possible (Step 608:YES) and merchandise is selected by the user, then conveyance of the merchandise under control of the merchandise conveyance unit 300 in FIG. 1 is performed, a refund process for disbursing change is performed with the control unit 110 of the coin processing unit 100 (Step 700), and the procedure is terminated.

In that case, if Step 608 determines that sale is possible (Step 608: YES), and no merchandise is selected then the procedure advances immediately to the refund process of Step 700.

Figure 4:
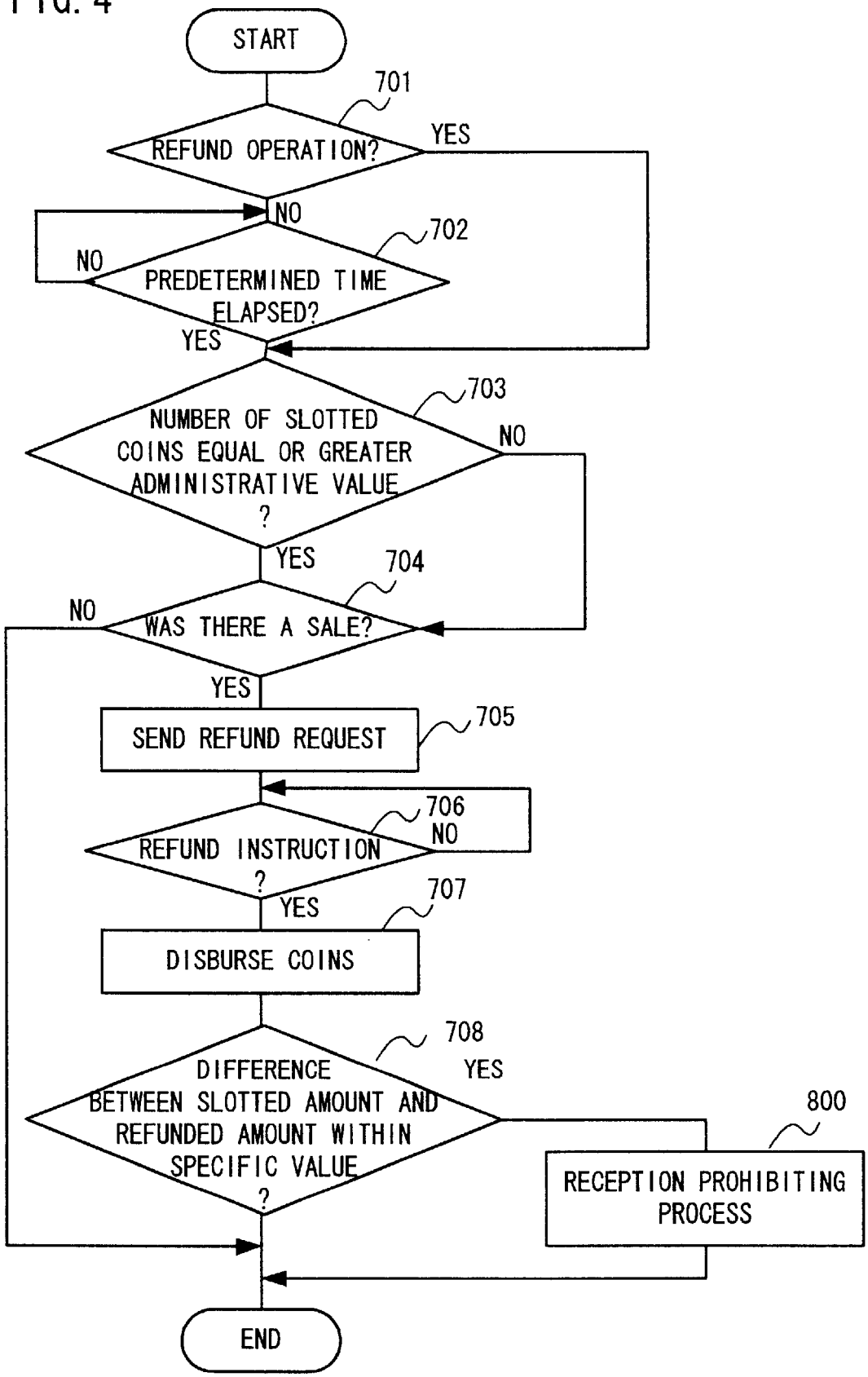
FIG. 4 is a flowchart showing the details of the refund process of Step 700 shown in FIG. 3.

FIG. 4 is a flowchart showing the details of the refund process of Step 700 shown in FIG. 3.

In FIG. 4, it is first determined, whether a refund operation is carried out by operating a refund switch (or refund lever) 111 (Step 701). If a refund operation is carried out (Step 701: YES), then the procedure advances to Step 703, and if no refund operation is carried out (Step 701: NO), then it is determined whether a predetermined period of time has passed since entering the refund processing (Step 702).

The decision at this Step 702 corresponds to the case that during a regular vending operation, merchandise is bought, but the refund switch 100 has not been operated even though there is change, or that no merchandise to be bought is selected even though coins are slotted, and in those cases, the vending machine automatically sends a refund request to the main control unit 500 after a predetermined period of time has passed, and if a refund instruction is sent back by the main control unit 500, then the necessary coins are automatically returned, based on this refund instruction.

That is to say, if a predetermined period of time has not yet-passed at Step 702 (Step 702: NO), the procedure waits until the predetermined period of time has passed, and when the predetermined period of time has passed (Step 702: YES), the procedure advances to Step 703.

At Step 703, it is determined whether the number of slotted coins is equal to or greater than a certain administrative value (Step 703). Here, the control unit 110 can count the number of slotted coins by denomination, based on the sensing output of the counting sensor 104 shown in FIG. 2, and the administrative value is the number of acceptable coins for each denomination that can be received per vending operation as preset by denomination in a setting operation with the setting unit 112.

This acceptable number (administrative value) is the largest number that can be slotted in one regular vending operation, and is set, for example in a vending machine selling merchandise for 120 yen to twenty 10-yen coins, four 50-yen coins, four 100-yen coins, and one 500-yen coin.

The reason for this is that, if two or more 500-yen coins are slotted to buy merchandise for 120 yen with this vending machine, then this may indicate the intention of fraudulent use, or if four or more 100-yen coins are slotted, then this may indicate the intention of fraudulent use that deviates from the proper use. Also the slotting of four or more 50-yen coins or twenty or more 10-yen coins are slotted is unnatural and may indicate the intention of fraudulent use.

The administrative values for each denomination are set to optimal values under consideration of, for example, the price of the merchandise to be sold with the vending machine, the usage environment, and margins for the erroneous slotting by the user. Also for vending machines that allow the consecutive purchase of a plurality of goods, the administrative values for each denomination are set under consideration of the possibility of such consecutive purchase.

In the foregoing explanations, the administrative values for each denomination are set in a setting operation with the setting unit 112, but it is also possible to set them automatically, based on information sent by the main control unit 500, in the coin processing unit 100 that can communicate with the main control unit, as shown in FIG. 1. In that case, the acceptable number for each denomination can be sent directly from the main control unit 500, or the highest price of merchandise and the number of possible consecutive purchases are sent from the main control unit 500, and based on this information, the coin processing unit 100 performs the necessary calculations based on the configuration of the used coins with the coin processing unit 100, and setting is performed automatically.

If Step 703 determines that the number of slotted coins is equal to or larger than the administrative value (Step 703: YES), then it is determined next whether the sale of merchandise was performed (Step 707).

The decision at Step 703 is that of the numbers of the slotted coins for each denomination, if at least one is equal to or higher than the administrative value set for this denomination, then it is determined that the number of slotted coins is equal to or larger the administrative value, and the decision at Step 704 whether sale of merchandise was performed can be made by monitoring the signals from the main control unit 500 shown in FIG. 1 or the signals from the merchandise ejection unit 300.

If Step 704 determines that sale of merchandise was not performed (Step 704: NO), then:

coins of a certain denomination are slotted in number equal to or higher than the administrative value for that denomination and subsequently the return switch 111 is operated; or coins of a certain denomination are slotted in number equal to or higher than the administrative value for that denomination and subsequently the procedure has waited for the predetermined period of time of Step 702 to pass.

Thus, in those cases, the operation has deviated from the proper form of usage, and the possibility of fraudulent use with false coins is very high, so that the procedure terminates immediately.

In that case, no refund request is sent to the main control unit 500, so that the coins corresponding to the false coins relating to this fraudulent use are not returned.

If Step 703 has determined that the number of slotted coins has not yet reached the administrative value (Step 703: NO), or if Step 704 has determined that sale of merchandise was performed (Step 407: YES), then a refund request is sent to the main control unit 500 (Step 705).

Then it is determined whether the main control unit 500 is giving a refund instruction in response to the refund request (Step 706). Here, if there is not refund instruction (Step 706: NO), the procedure waits for the refund instruction from the main control unit 500, but if it is determined that there is a refund instruction (Step 706: YES), then, based on this refund instruction, the coin dispensing unit 108 shown in FIG. 2 is caused to perform a coin disbursement process, disbursing the necessary amount of coins as indicated by the refund instruction from the coin accumulation unit 106 and ejecting them into the coin returning unit 109 (Step 707).

Next, it is determined whether the difference between the amount of money slotted into the coin processing unit 100 and the money to be refunded as indicated by the refund instruction from the main control unit 500 is within a predetermined specific value (Step 708).

This specific value is set for example in accordance with the lowest vending price of the merchandise sold with this vending machine.

If at Step 708 the difference between the amount of money slotted into the coin processing unit 100 and the money to be refunded as indicated by the refund instruction from the main control unit 500 exceeds the predetermined specific value (Step 708: NO), then this is taken as a proper regular vending operation, and the procedure is terminated.

If, however, Step 708 determines that the difference between the amount of money slotted into the coin processing unit 100 and the money to be refunded as indicated by the refund instruction from the main control unit 500 is within the predetermined specific value (Step 708: YES), then this may indicate a operation based on another way of fraudulent use, namely that a large number of false coins of a certain denomination is slotted to purchase the merchandise with the lowest price, and then the return switch 111 is operated to get hold of the true coins of this denomination in the vending machine, so that in that case, a reception prohibiting process is performed, temporarily prohibiting the reception of coins of this denomination in this vending machine (Step 800).

Figure 5:
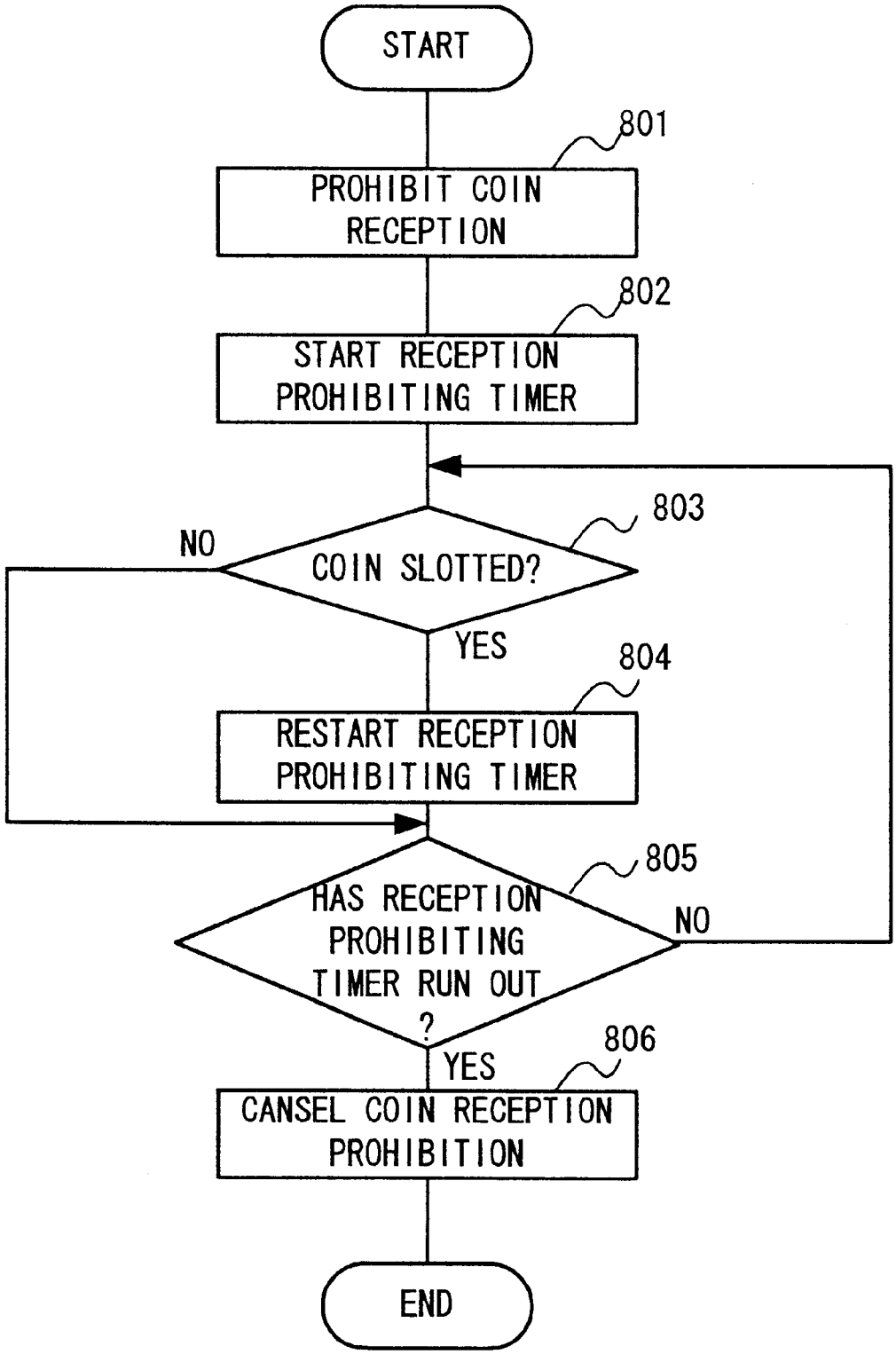
FIG. 5 is a flowchart showing the details of an example of the reception prohibiting process of Step 800 shown in FIG. 4.

FIG. 5 is a flowchart showing the details of an example of the reception prohibiting process of Step 800 shown in FIG. 4.

In FIG. 5, first, when entering the procedure, the vending machine is set into the coin reception prohibiting state, in which the true-coin/false-coin separating unit 103 is caused to guide coins that are slotted into the coin slotting unit 101 and whose reception is prohibited into the coin returning unit 109, regardless of whether they are true or false coins (Step 801). Then, a reception prohibiting timer is started (Step 802).

Next, it is monitored whether a coin of this denomination is slotted into the coin slotting unit 101 (Step 803). If no coin of this denomination is slotted (Step 803: NO), then the procedure advance to Step 805, and if it is determined that a coin of this denomination was slotted (Step 803: YES), then the reception prohibiting timer is restarted (Step 804), and the procedure advances to, Step 805.

At Step 805, it is determined whether the reception prohibiting timer has run out. If it has not run out (Step 805: NO), then the procedure returns to 803, and if it has run out (Step 805: YES), then the coin reception prohibiting state is cancelled (Step 806), and the procedure is terminated.

This means, in the reception prohibiting process, there is a selective prohibition of the reception of coins of the denomination whose reception is prohibited, and if a coin of the denomination whose reception is prohibited is slotted again during the monitoring time of the reception prohibiting timer, then the monitoring time of the reception prohibiting timer is renewed, and when the monitoring time of the reception prohibiting timer has terminated, the, prohibiting of the reception of coins of the denomination whose reception is prohibited is cancelled.

This means, when trying to get hold of the true coins in the vending machine by using false coins, the same operation is usually repeated a number of times, and in this case, when for example somebody performs the fraudulent operation of slotting a large number of fraudulent 100 coins, purchasing the merchandise with the lowest price, and operating the return switch 111, then, with the present embodiment, the change is reimbursed at the first time, but subsequently, when trying to perform the same fraudulent operation by slotting fraudulent 100 coins, due to the effect of the reception prohibiting timer in the reception prohibiting process, the fraudulent 100 coins are not accepted and returned into the coin returning unit 109, so that this fraudulent operation will end as a failure, and the damage due to this kind of fraudulent operation can be kept at a minimum.

It should be noted that in this configuration, the reception prohibiting process prohibits the reception of coins of a specified denomination only, and that coins of other denominations are accepted, so that vending of merchandise is still possible by slotting other denominations.

However, it is also possible to prohibit the reception of coins of all denominations during the reception prohibiting process.

Furthermore, in the above reception prohibiting process, the monitoring period of the reception prohibiting timer is constant, and each time this kind of coin is slotted again, the monitoring time of the reception prohibiting timer is renewed, but it is also possible to renew the monitoring time of the reception prohibiting timer such that it becomes progressively longer each time this kind of coin is slotted again.

Figure 6:
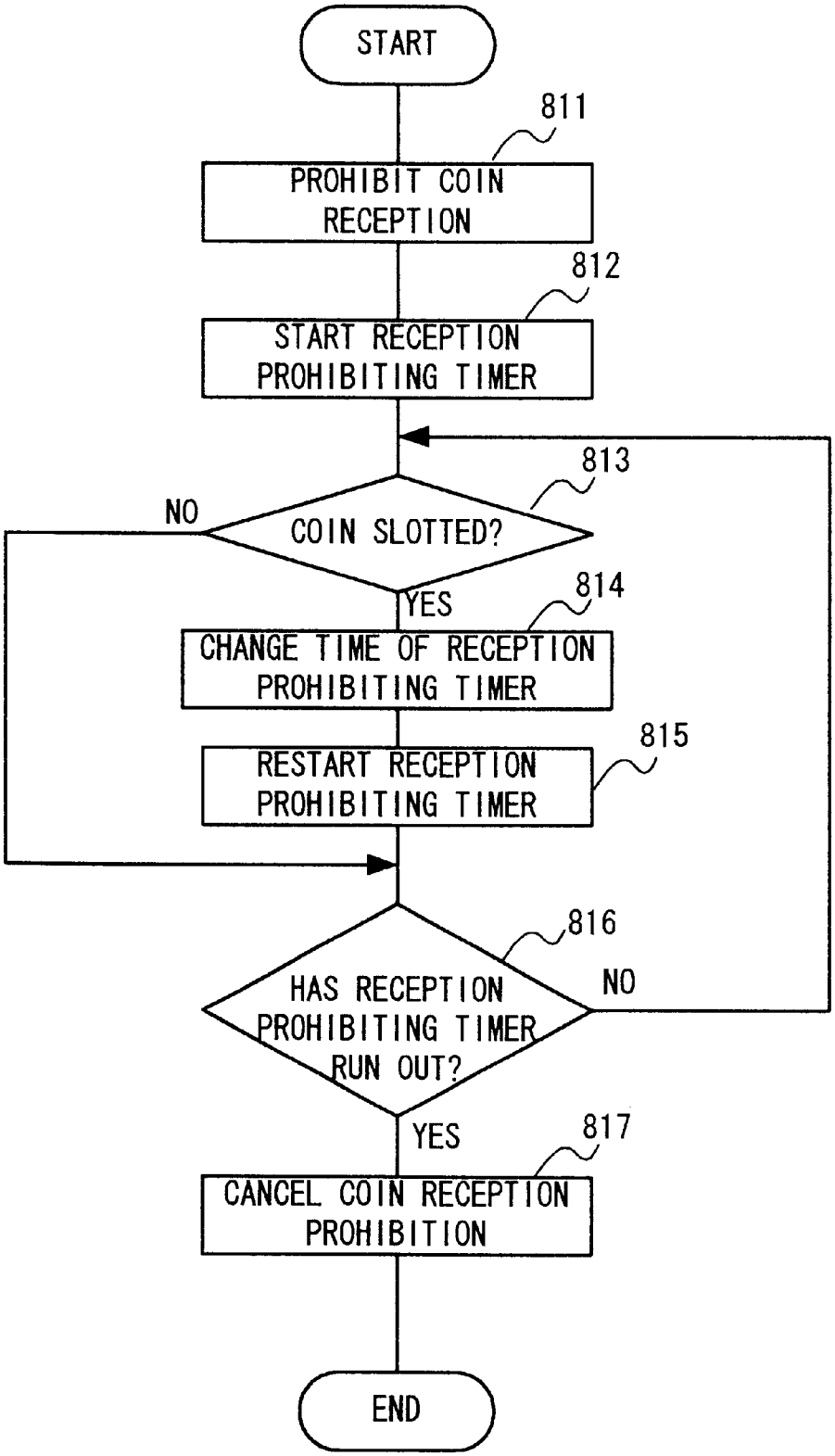
FIG. 6 is a flowchart showing the details of another example of the reception prohibiting process of Step 800 shown in FIG. 4.

FIG. 6 is a flowchart showing the details of another example of the reception prohibiting process of Step. 800 shown in FIG. 4.

In the reception prohibiting process shown in FIG. 6, the monitoring time of the reception prohibiting timer is renewed such that it becomes progressively longer each time a coin is slotted again.

That is to say, first, when entering the processing of FIG. 6, the vending machine is set into the coin reception prohibiting state, in which the true-coin/false-coin separating unit 103 is caused to guide coins that are slotted into the coin slotting unit 101 and whose reception is prohibited into the coin returning unit 109, regardless of whether they are true or false coins (Step 811). Then, the reception prohibiting timer is started (Step 812).

Next, it is monitored whether a coin of this denomination is slotted into the coin slotting unit 101 (Step 813). If no coin of this denomination is slotted (Step 813: NO), then the procedure advance to Step 816, and if it is determined that a coin of this denomination was slotted (Step 813: YES), then the reception prohibiting time (monitoring time)of the reception prohibiting timer is prolonged (Step. 814), the reception prohibiting timer is restarted (Step 815), and the procedure advances to Step 816.

At Step 816, it is determined whether the reception prohibiting timer has run out. If it has not run out (Step 816: NO), then the procedure returns to 813, and if it has run out (Step 816: YES), then the coin reception prohibiting state is cancelled (Step 817), and the procedure is terminated.

This means, in the reception prohibiting process, there is a selective prohibition of the reception of coins of the denomination whose reception is prohibited, and if a coin of the denomination whose reception is prohibited is slotted again during the monitoring time of the reception prohibiting timer, then the monitoring time of the reception prohibiting timer is renewed so that it becomes progressively longer, and when the monitoring time of the reception prohibiting timer has terminated, the prohibiting of the reception of coins of the denomination whose reception is prohibited is cancelled.

With this configuration, this kind of fraudulent operation using false coins becomes even more difficult, so that this kind of fraudulent use can be greatly reduced.

Figure 7:
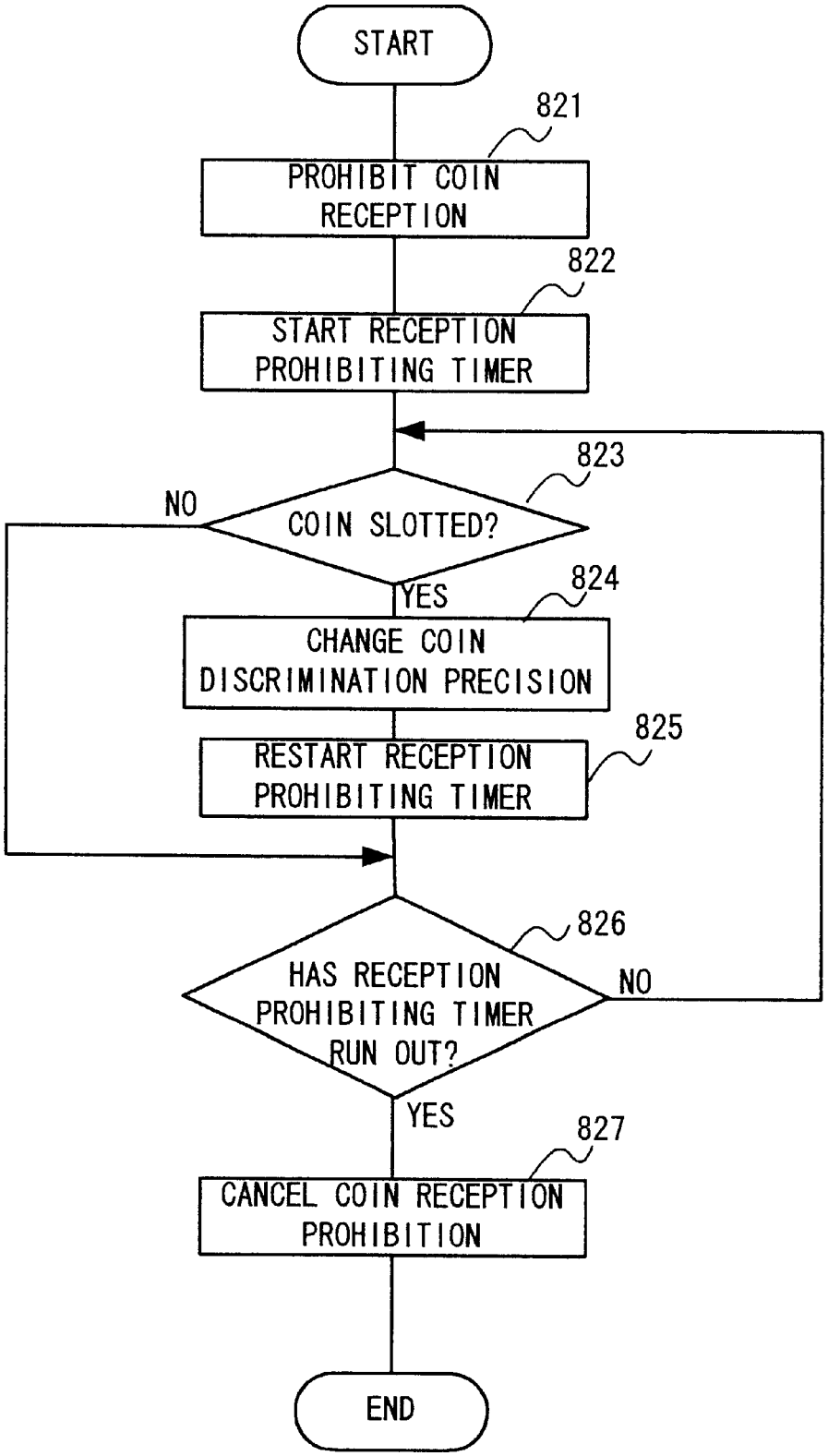
FIG. 7 is a flowchart showing the details of yet another example of the reception prohibiting process of Step 800 shown in FIG. 4.

FIG. 7 is a flowchart showing the details of yet another example of the reception prohibiting process of Step 800 shown in FIG. 4.

In the reception prohibiting process shown in FIG. 7, the precision with which the corresponding type of coins is discriminated is renewed such that it becomes progressively higher each time a coin is slotted again.

That is to say, first, when entering the processing of FIG. 7, the vending machine is set into the coin reception prohibiting state, in which the true-coin/false-coin separating unit 103 is caused to guide coins that are slotted into the coin slotting unit 101 and whose reception is prohibited into the coin returning unit 109, regardless of whether they are true or false coin (Step 821). Then, the reception prohibiting timer is started (Step 822).

Next, it is monitored whether a coin of this denomination is slotted into the coin slotting unit 101 (Step 823). If no coin of this denomination is slotted (Step 823: NO), then the procedure advance to Step 826, and if it is determined that a coin of this denomination was slotted (Step 823:YES), then the precision with which the coins is discriminated is increased (Step 824), the reception prohibiting timer is restarted (Step 825), and the procedure advances to Step 826.

Here, the control of the precision with which the coins are sorted is performed with the control unit 110 shown in FIG. 2.

That is to say, depending on whether the detection signal from the coin discriminating sensor 102, which corresponds to material, diameter, surface pattern, etc. of the coin fits into the preset window, that is, between an upper and a lower threshold, the control unit 110 discriminates whether the slotted coin is true or fraudulent, and if it is true, of which denomination it is, and in Step 824, the size of the window for discriminating the slotted coin, that is the interval between the upper and the lower threshold is set to a narrower size.

At Step 826, it is determined whether the reception prohibiting timer has run out. If it has not run out (Step 826: NO), then the procedure returns to 823, and if it has run out (Step 826: YES), then the coin reception prohibiting state is cancelled (Step 827), and the procedure is terminated.

This means, in the reception prohibiting process, there is a selective prohibition of the reception of coins of the denomination whose reception is prohibited, and if a coin of the denomination whose reception is prohibited is slotted again during the monitoring time of the reception prohibiting timer, then the precision with which that type of coins is discriminated is changed so that it becomes progressively higher, and the monitoring time of the reception prohibiting timer is renewed. Then, when the monitoring time of the reception prohibiting timer has terminated, the prohibiting of the reception of coins of the denomination whose reception is prohibited is cancelled.

With this configuration, the vending machine's precision with which that type of coins is discriminated becomes higher as this kind of fraudulent operation is repeated, so that this kind of fraudulent use with false coins, becomes even more difficult.

It should be noted that the precision with which the coins are discriminated, which is increased by the processing of Step 824, can be restored to an original precision under the condition that, for example, a predetermined number of regular vending operations are performed consecutively.

Figure 8:
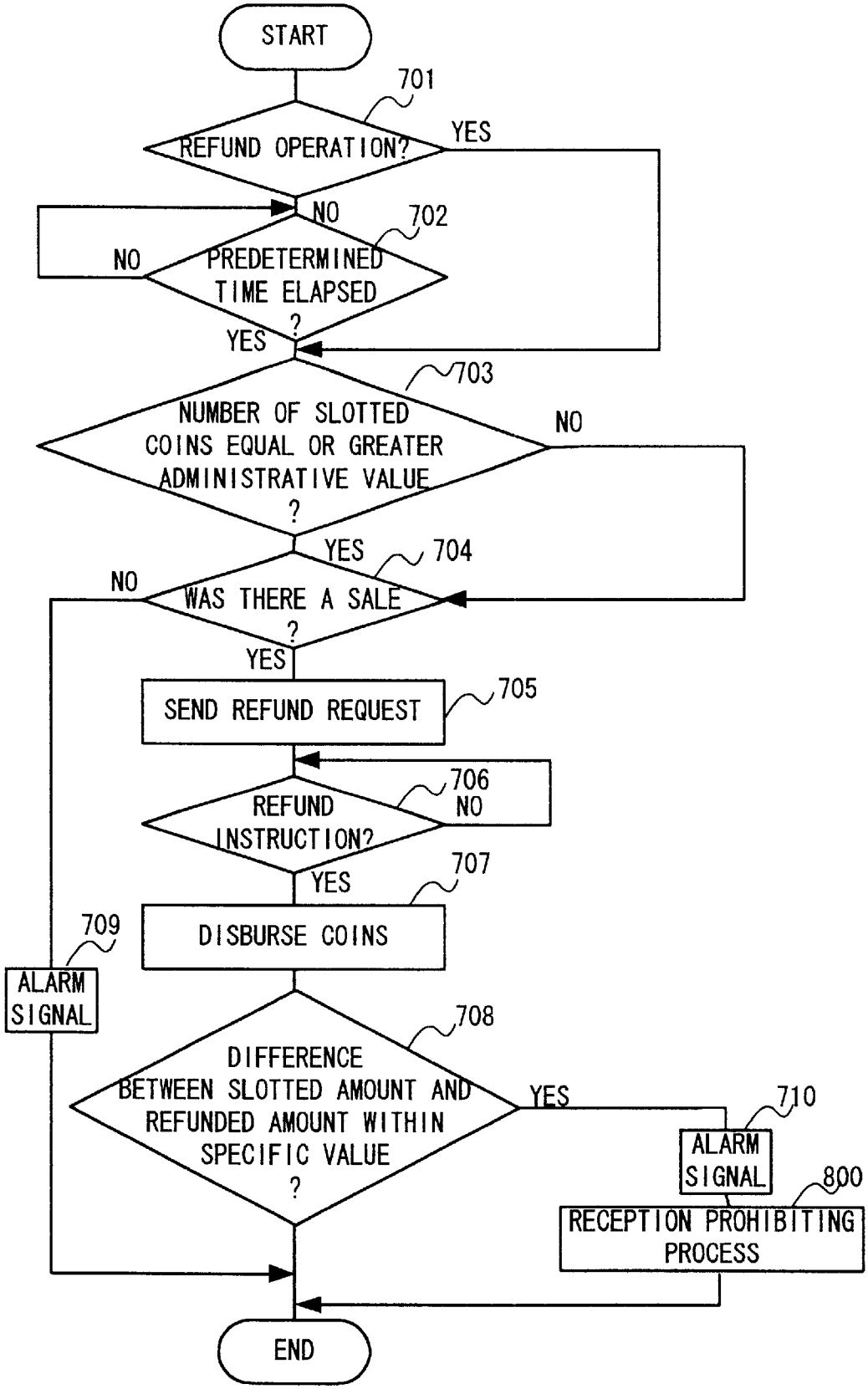
FIG. 8 is a flowchart showing the details of another example of the refund process of Step 700 shown in FIG. 3.

FIG. 8 is a flowchart showing the details of another example of the refund process of Step 700 shown in FIG. 3.

The refund process shown in FIG. 8 is basically the same as the refund process shown in FIG. 4, but the refund process shown in FIG. 8 differs from the refund process shown in FIG. 4 in that an alarm signal is generated when an fraudulent operation is performed. In FIG. 8, the steps performing processes that are equivalent to FIG. 4 are marked by the same symbols as used in FIG. 4, and their further explanation is omitted.

FIG. 8, if Step 704 determines that a sale has not been carried out (Step 704: NO), then an alarm signal indicating fraudulent use is generated (Step 709), and also if in Step 708 the difference between the amount of slotted money and the refunded amount of money is within a specified value (Step 708: YES), then an alarm signal indicating fraudulent use is generated.

Here, the alarm signal generated in Step 709 and the alarm signal generated in Step 710 can be the identical signals or different signals.

Here, the purpose of the alarm signals is to cause the abuser to retreat, which can be accomplished, for example, by flashing a lamp illuminating the merchandise or the generation of an alarm sound.

Thus, this kind of fraudulent operation using fraudulent money becomes even more difficult, so that this kind of fraudulent use can be greatly reduced.

Figure 9:
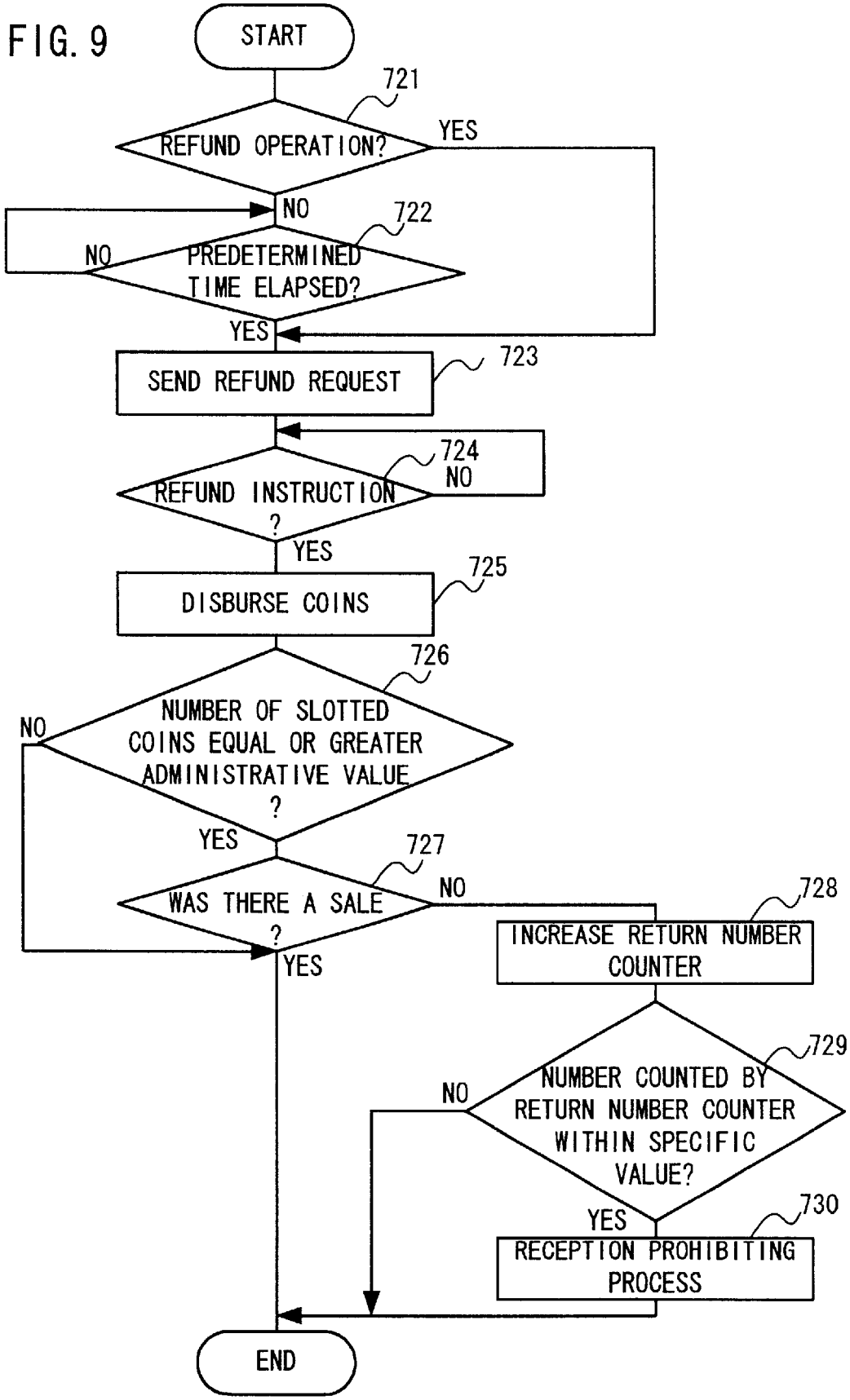
FIG. 9 is a flowchart showing yet another example of the refund process of Step 700 shown in FIG. 3.

FIG. 9 is a flowchart showing yet another example of the refund process of Step 700 shown in FIG. 3.

In the refund process shown in FIG. 9, if number of coins equal to or larger than a predetermined administrative value is slotted and a refund operation is carried out with the refund switch 111 without purchasing anything, then amount of coins corresponding to the slotted coins is refunded, but this operation is counted, and if the counted value reaches a preset number, then the reception of this kind of coin is prohibited.

That is to say, in FIG. 9, it is first determined whether a refund operation is carried out by operating the refund switch (or refund lever) 111 (Step 721). Here, if a refund operation is carried out (Step 721: YES), the procedure advances to Step 723, and if no refund operation is carried out (Step 721: NO), it is determined whether a predetermined period of time has passed since entering the refund processing (Step 722).

If the predetermined period of time has not yet passed (Step 722: NO), then the procedure waits until the predetermined period of time has passed, and when the predetermined period of time has passed (Step 722: YES), then the procedure advances to Step 723.

At Step 723, a refund request is sent to the main control unit 500. Then, it is determined whether there is a refund instruction given by the main control unit 500 in response to the refund request (Step 724).

If there is no refund instruction (Step 724: NO), then the procedure waits until there is a refund instruction from the main control unit 500, but if it is determined that there is a refund instruction (Step 724: YES), then, based on this refund instruction, the coin dispensing unit 108 shown in FIG. 2 is caused to perform a coin disbursement process, disbursing the necessary amount of coins as indicated by the refund instruction from the coin accumulation unit 106 and ejecting them into the coin returning unit 109 (Step 725).

Next, it is determined-whether the number of slotted coins is equal to or larger than the administrative value (Step 726). If it is determined that the number of slotted coins is equal to or larger than the administrative value (Step 726: YES), then it is determined whether merchandise is sold (Step 727).

If it is determined that merchandised is sold (Step 727: YES) or if it is determined at Step 726 that the number of slotted coins has not yet reached the administrative value (Step 726: NO), then this is taken as a proper sale, and the procedure is terminated.

If it is determined at Step 727 that no merchandise is sold (Step 727: NO), then this means that 1) Coins of a certain denomination are slotted in number equal to or higher than the administrative value for that denomination and subsequently the return switch 111 is operated; or
2) Coins of a certain denomination are slotted in number equal to or higher than the administrative value for that denomination and subsequently the procedure has waited for the predetermined period of time of Step 722 to pass.

Thus, in those cases, the operation has deviated from the proper form of usage, and the possibility of fraudulent use with false coins is very high, so that the return number counter is increased (Step 728).

Then, it is determined whether the count value of the return number counter has reached a preset specified value (Step 729). Here, if the count value of the return number counter has not reached the predetermined specific value (Step 729: NO), the procedure is terminated.

If it is determined that the, count value of the return number counter has reached the specific value (Step 729: YES), then this is taken as fraudulent use, and a reception prohibiting process is performed, temporarily prohibiting the reception of coins of a certain denomination in this vending machine (Step 800).

The reception prohibiting process of Step 800 is the same as the process explained for the flowcharts in FIGS. 5 to 7.

When a proper vending operation is performed, the count value of the return number counter is cleared.

It should be noted that it is also possible to provide a return monitoring timer for the return number counter, and to increase the return number counter under the condition that the next fraudulent operation is performed during the monitoring period of this return monitoring timer. With this configuration, the return monitoring timer is renewed every time an fraudulent operation is performed.

FIG. 10 is a flowchart showing yet another example of the refund process of Step 700 shown in FIG. 3.

In the refund process shown in FIG. 10, if number of coins equal to or larger than a predetermined administrative value is slotted and a refund operation is carried out without purchasing merchandise, then amount of coins corresponding to the slotted coins is returned, but the reception of this type of coins is prohibited for a preset period of time, or, if the number of slotted coins has not yet reached the corresponding administrative value and a refund operation is carried out without purchasing merchandise, then this operation is counted, and if the counted value reaches a preset number, then the reception of this kind of coin is prohibited.

That is to say, in FIG. 10, it is first determined whether a refund operation is carried out by operating the refund switch (or refund lever) 111 (Step 731). Here, if a refund operation is carried out (Step 731: YES), the procedure advances to Step 733, and if no refund operation is carried out (Step 731: NO), it is determined whether a predetermined period of time has passed since entering the refund processing (Step. 732).

If the predetermined period of time has not yet passed (Step 732: NO), then the procedure waits until the predetermined period of time has passed, and when the predetermined period of time has passed (Step 732: YES), then the procedure advances to Step 733.

At Step 733, a refund request is sent to the main control unit 500. Then it is determined whether there is a refund instruction given by the main control unit 500 in response to the refund request (Step 734).

If there is no refund instruction (Step 734: NO), then the procedure waits until there is a refund instruction from the main control unit 500, but if it is determined that there is a refund instruction (Step 734: YES), then, based on this refund instruction, the coin dispensing unit 108 shown in FIG. 2 is caused to perform a coin disbursement process, disbursing the necessary amount of coins as indicated by the refund instruction from the coin accumulation unit 106 and ejecting them into the coin returning unit 109 (Step 735).

Next, it is determined whether the number of slotted coins is equal to or larger than the administrative value (Step 736). If it is determined that the number of slotted coins is equal to or larger than the administrative value (Step 736: YES), then it is determined whether merchandise is sold (Step 737). Here, if it is determined that merchandise is sold, then this is taken as a proper operation, and the procedure is terminated.

If it is determined at Step 737 that no merchandise is sold (Step 737: NO), then this means that

- coins of a certain denomination are slotted in number equal to or higher than the administrative value for that denomination and, the return switch 111 is operated without purchasing merchandise; or
- coins of a certain denomination are slotted in number equal to or higher than the administrative value for that denomination and the procedure has waited for the predetermined period of time of Step 732 to pass without a purchase of merchandise.

Thus, the possibility of fraudulent use with false coins is very high, so that the procedure advances to Step 800 and the reception prohibiting process of Step 800 is carried out. The reception prohibiting process of Step 800 is the same as the process explained for the flowcharts in FIGS. 5 to 7.

If it is determined at Step 736 that the number of slotted coins has not yet reached the administrative value (Step 736: NO), then it is determined whether merchandise is sold (Step 738).

If it is determined that merchandise is sold (Step 738: YES), then this is taken as a proper sale, and the procedure is terminated.

If it is determined at Step 738 that merchandise has not been sold (Step 738: NO), then this means that 1) Coins of a certain denomination are slotted in number smaller than the administrative value for that denomination and the return switch 111 is operated without purchasing merchandise; or
2) Coins of a certain denomination are slotted in number smaller than the administrative value for that denomination and subsequently the procedure has waited for the predetermined period of time of Step 732 to pass without a purchase of merchandise.

Thus, the possibility of fraudulent use with false coins is taken to be very high, so that the return number counter is increased (Step 739).

Then it is determined at Step 740 whether the count value of the return number counter has reached the predetermined specific value (Step 740). If the count value of the return number counter has not yet reached the specific value (Step 740: NO), then the procedure is terminated.

If it is determined that the count value of the return number counter has reached the specific value (Step 740: YES), then this is taken as a fraudulent use, and a reception prohibiting process is performed, temporarily prohibiting the reception of coins of a certain denomination in this vending machine (Step 800).

The reception prohibiting process of Step 800 is the same as the process explained for the flowcharts in FIGS. 5 to 7.

When a proper Vending operation is performed, the count value of the return number counter is cleared.

It should be noted that also in this embodiment it is possible to provide a return monitoring timer for the return number counter, and to increase the return number counter under the condition that the next fraudulent operation is performed during the monitoring period of this return monitoring timer. With this configuration, the return monitoring timer is renewed every time an fraudulent operation is performed.

In the above-described embodiments, the various kinds of control are performed based on the communication with the main control unit 500 that is connected by the communication cable 400 shown in FIG. 1, but instead of this configuration, it is of course also possible to apply the invention similarly to a vending machine in which for example the control unit 110 of the coin processing unit 100 fulfills a similar function as the main control unit 500.

INDUSTRIAL APPLICABILITY

The present invention relates to a vending machine, with which fraudulent use of false coins of various denominations can be prevented. With this invention, fraudulent use of false coins of various denomination can be prevented effectively.

What is claimed is:

1. A vending machine which counts an amount of slotted money, vends merchandise within a range of the counted amount of slotted money, and returns money corresponding to a return amount based on a refund instruction, characterized in that the vending machine comprises:

counting means for counting, by denomination, the number of slotted coins of the slotted money;

setting means for setting, by denomination, an administrative value indicating number of slotted coins that is acceptable in one vending operation;

a judging means for judging, by denomination, whether the number of slotted coins counted by the counting means is equal to or larger than the administrative value set with the setting means;

detecting means for detecting refund instruction;

refund prohibiting means for prohibiting a coin refund operation based on the refund instruction, if the judging means judges that there is at least one denomination for which the number of slotted coins counted by the counting means is equal to or larger than the administrative value set with the setting means when the refund instruction is detected by the detecting means without a sale of merchandise; and reception prohibiting means for prohibiting reception of coins for a predetermined period of time after the coin return operation is terminated if a difference between the amount of slotted money and the amount of money to be returned is within a predetermined specific value when the refund instruction is detected by the detecting means after the sale of merchandise.

2. The vending machine according to claim 1, characterized in that the reception prohibiting means comprises renewal means for renewing the predetermined period of time in which reception of coins is prohibited if a coin is slotted during the predetermined period of time.

3. The vending machine according to claim 1, characterized in that the reception prohibiting means comprises renewal means for renewing the predetermined period of time in which the reception of coins is prohibited such that it becomes progressively longer if a coin is slotted during the predetermined period of time.

4. The vending machine according to claim 1, characterized in that the reception prohibiting means comprises renewal means which increases a precision with which the coins is discriminated and renews the predetermined period of time in which the reception of coins is prohibited if a coin is slotted again during the predetermined period of time.

5. The vending machine according to claim 4, characterized in that the vending machine further comprises precision restoring means for restoring the precision with which the coins are discriminated that has been increased by the renewal means to an original discrimination precision, under the condition that a predetermined number of regular vending operations are carried out.

6. A vending machine having a main control unit and a coin processing unit, wherein in a coin return operation the main control unit counts an amount of slotted money based on communication with the coin processing unit, calculates an amount of money to be return based on a refund request from the coin processing unit and gives the coin processing unit a refund instruction to refund coins corresponding to the amount of money to be returned, and wherein the coin processing unit returns coins based on the refund instruction, characterized in that the coin processing unit comprises:

counting means for counting, by denomination, the number of slotted coins;

setting means for setting, by denomination, an administrative value indicating number of slotted coins that is acceptable in one vending operation;

judging means for judging by denomination, whether the number of slotted coins counted by the counting means is equal to or larger than the administrative value set with the setting means;

detecting means for detecting a refund instruction;

transmission prohibiting means for prohibiting sending of the refund request to the main control unit, if the judging means judges that there is at least one denomination for which the number of slotted coins counted by the counting means is equal to or larger than the administrative value set with the setting means when the refund instruction is detected by the detecting means without a sale of merchandise; and reception prohibiting means for prohibiting reception of coins for a predetermined period of time after the coin return operation is terminated if a difference between the amount of slotted money and the amount to be returned is within a predetermined specific value when the refund instruction is detected by the detecting means after the sale of merchandise.

7. The vending machine according to claim 6, characterized in that the reception prohibiting means comprises renewal means for renewing the predetermined period of time in which reception of coins is prohibited if a coin is slotted during the predetermined period of time.

8. The vending machine according to claim 6, characterized in that the reception prohibiting means comprises renewal means for renewing the predetermined period of time in which the reception of coins is prohibited such that it becomes progressively longer if a coin is slotted during the predetermined period of time.

9. The vending machine according to claim 6, characterized in that the reception prohibiting means comprises renewal means which increases a precision with which the coins is discriminated and renews the predetermined period of time in which the reception of coins is prohibited if a coin is slotted again during the predetermined period of time.

10. The vending machine according to claim 9, characterized in that the vending machine further comprises precision restoring means for restoring the precision with which the coins are discriminated that has been increased by the renewal means to an original discrimination precision, under the condition that a predetermined number of regular vending operations are carried out.

* * * * *